US005744910A

United States Patent [19]

Symons

[11] Patent Number: 5,744,910

[45] Date of Patent: Apr. 28, 1998

[54] PERIODIC PERMANENT MAGNET FOCUSING SYSTEM FOR ELECTRON BEAM

[75] Inventor: Robert Spencer Symons, Los Altos, Calif.

[73] Assignee: Litton Systems, Inc., Woodland Hills, Calif.

[21] Appl. No.: 41,765

[22] Filed: Apr. 2, 1993

[51] Int. Cl.[6] ..... H01J 23/087

[52] U.S. Cl. ..... 315/5.35; 335/210; 335/306

[58] Field of Search ..... 315/5.35; 335/210, 335/306

[56] References Cited

U.S. PATENT DOCUMENTS

| | | | |
|---|---|---|---|
| 2,876,373 | 3/1959 | Veith et al. | 335/210 |
| 2,956,193 | 10/1960 | De Wit | 335/210 X |
| 3,181,042 | 4/1965 | Stock | 335/210 |
| 3,182,234 | 5/1965 | Meyerer | 335/210 |
| 3,755,706 | 8/1973 | Scott | 315/5.35 X |
| 4,433,270 | 2/1984 | Drozdov | 315/5.35 |
| 4,542,581 | 9/1985 | Wolfram | 315/5.35 X |
| 4,800,322 | 1/1989 | Symons | 315/5.39 |
| 4,931,694 | 6/1990 | Symons et al. | 315/3.5 |
| 4,931,695 | 6/1990 | Symons | 315/5.39 |

FOREIGN PATENT DOCUMENTS

| | | |
|---|---|---|
| 853061 | 11/1960 | Germany . |
| 2266990 | 11/1993 | United Kingdom . |
| 2266991 | 11/1993 | United Kingdom . |

*Primary Examiner*—Benny T. Lee
*Attorney, Agent, or Firm*—Graham & James LLP

[57] ABSTRACT

A focusing system for a helix TWT includes a polepiece structure for conducting magnetic flux to a drift tube of the TWT in a first general direction and conducting the magnetic flux from the drift tube in a second general direction perpendicular to the first general direction. Radially magnetized permanent magnets are disposed at outer portions of the polepiece structure and supply the magnetic flux. A first pair of the magnets have a first direction of polarity, and a second pair of the magnets have a second direction of polarity opposite to the first direction. An outer shell encapsulates the polepiece structure and the magnets, and provides a magnetic flux return path. An electron beam travels in the drift tube and the magnetic flux provides focusing for the electron beam.

20 Claims, 2 Drawing Sheets

PERIODIC PERMANENT MAGNET FOCUSING SYSTEM FOR ELECTRON BEAM

BACKGROUND OF THE INVENTION

1. Field of the Invention

The present invention relates to microwave amplification tubes, and more particularly, to a periodic permanent magnet focusing system for a traveling wave tube used in a phased array radar or any other electronic system using traveling wave tubes in close proximity together.

2. Description of Related Art

Microwave amplification tubes, such as traveling wave tubes (TWTs), are effective at increasing the gain of an electromagnetic wave signal in the microwave frequency range. A TWT is a linear beam device which utilizes an electron beam originating from an electron gun which propagates through a tunnel or drift tube generally contained within an interaction structure. At the end of its travel, the electron beam is deposited within a collector or beam dump which effectively captures the spent electron beam. The beam is generally focused by magnetic or electrostatic fields in the interaction structure of the device in order for it to be effectively transported from the electron gun to the collector without energy loss to the interaction structure. The electromagnetic wave can be made to propagate through the interaction structure in which it interacts with the electron beam. The beam gives up energy to the propagating wave, thus increasing the power of the wave.

One particular type of TWT utilizes a wire helix which extends through the axial length of the drift tube. The electron beam is injected along the axis of the helix, and the electromagnetic wave travels along the helix at approximately the same speed as the electron beam. In a helix TWT, interaction between the beam and the electromagnetic wave is continuous throughout the drift tube. Helix TWTs are in widespread use due to their extremely broad bandwidth characteristics.

One desirable application of helix TWTs is to provide an element for use in a phased array radar. A phased array radar is an array of antennas having their outputs coherently combined in a beam-forming network. The outputs can be provided by a two dimensional matrix of TWTs, each producing a distinct microwave output signal. To be effective in a phased array radar, the TWTs must be compact enough to fit behind the antenna element of the phased array and have sufficient cooling to permit the generation of a substantial amount of power.

A significant problem with using conventional helix TWTs in a phased array is that of controlling leakage of the magnetic field used for beam focusing. With the TWTs disposed in close proximity within the matrix, any magnetic field leakage from one TWT could adversely impact the magnetic focusing of an adjacent TWT. The magnetic leakage problem compounds efforts to sufficiently test individual TWT elements, since each element must be tested in place within the matrix to accurately measure its performance degradation due to the magnetic leakage from the adjacent TWTs.

A secondary problem with conventional helix TWTs is that of providing a sufficient thermal path from within the tube to an external heat sink. Conventional TWTs utilize toroidally shaped, axially magnetized samarium-cobalt magnets for beam focusing, which provide generally poor thermal conductivity in the axial direction. As a result, conventional TWTs rely upon generally radial thermal conductivity through the tube to an external coolant jacket or heat sink. With the TWTs disposed in close proximity alongside each other, there is insufficient space to include a heat sink external to the TWT. Instead, heat must be extracted from an end of the TWT, such as at the face of the phased array, and the TWT must have high axial thermal conductivity in order to draw the heat to the heat sink at the end of the TWT.

Accordingly, a need exists to provide a helix TWT which can be advantageously used in a phased array radar or any other electronic system using TWTs in close proximity together. Ideally, the TWT should have substantially no magnetic field leakage while also having high thermal conductivity in the axial direction.

SUMMARY OF THE INVENTION

In addressing these needs and deficiencies of the prior art, an improved periodic permanent magnet focusing system for a helix TWT is provided.

The focusing system of the present invention comprises a polepiece structure for conducting magnetic flux to a drift tube of the TWT in a first general direction and conducting the magnetic flux from the drift tube in a second general direction perpendicular to the first general direction. Radially magnetized permanent magnets are disposed at outer portions of the polepiece structure and supply the magnetic flux. A first pair of the magnets have a first direction of polarity, and a second pair of the magnets have a second direction of polarity opposite to the first direction. An outer shell encapsulates the polepiece structure and the magnets, and provides a magnetic flux return path for the magnets. An electron beam travels in the drift tube and the magnetic flux provides focusing for the electron beam.

More particularly, the polepiece structure includes first magnetic polepieces extending radially through the drift tube and parallel to each other. Second magnetic polepieces also extend radially through the drift tube and parallel to each other. The second polepieces are interlaced with and orthogonal to the first polepieces. A first pair of end panels join opposite end portions of the first polepieces, respectively. The first polepieces and the first end panels provide a first ladder-shaped member. Similarly, a second pair of end panels join opposite end portions of the second polepieces, respectively. The second polepieces and the second end panels provide a second ladder-shaped member. Non-magnetic spacers are interlaced between the individual first and second polepieces, the spacers having a generally cross-shaped configuration. The first ladder-shaped member and the second ladder-shaped member are interlaced and orthogonal to each other.

In a preferred embodiment of the present invention, the polepieces are generally rectangular. The first portion of magnets adjoin the first polepieces and have the first direction of polarity, and the magnets adjoining the second polepieces have the second direction/of polarity. The orthogonal configuration of the polepieces permits the formation of a corner formed by an inner section of the first and second polepiece portions within the outer shell. The corner permits the use of a chill bar which extends axially along the length of the polepiece structure and removes heat from the structure in an axial direction. Additional vacant corners can provide access space for insertion of coaxial cables therethrough.

A more complete understanding of the periodic permanent magnet focusing system for an electron beam will be afforded to those skilled in the art, as well as a realization of additional advantages and objects thereof, by a consideration of the following detailed description of the preferred embodiment. Reference will be made to the appended sheets of drawings which will be first described briefly.

DETAILED DESCRIPTION OF THE PREFERRED EMBODIMENT

Figure 1:
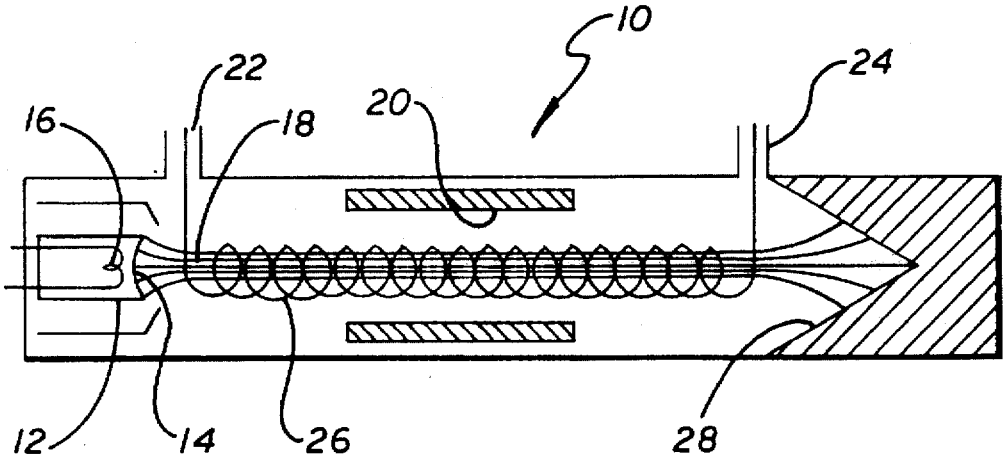
FIG. 1 PRIOR ART
FIG. 1 is a block diagram illustrating a prior art helix traveling wave tube (TWT)

Referring first to FIG. 1, a prior art periodic permanent magnet focusing helix TWT 10 is illustrated. The helix TWT 10 has an electron gun 12 with a cathode surface 14 and a thermionic heating element 16 disposed below the surface. An electron beam 18 is drawn from the cathode surface 14 by activating the heating element 16 and applying a highly negative voltage to the cathode. The electron beam 18 travels axially through a drift tube 20 of the helix TWT 10, and is deposited in a collector 28.

An RF electromagnetic wave input signal is provided through an RF input port 22. The input signal travels along a helix 26 which extends the length of the drift tube 20. The helix 26 is typically formed from a coiled length of tungsten wire, and the electron beam 18 travels axially through the radial center of the helix. The electric field produced by the RF input signal causes periodic bunching of the electrons of the electron beam 18, which permits efficient energy transfer from the electrons to the signal. The electronic interaction within the helix TWT 10 produces an amplified RF output signal, which is then provided to an RF output port 24.

Figure 2:
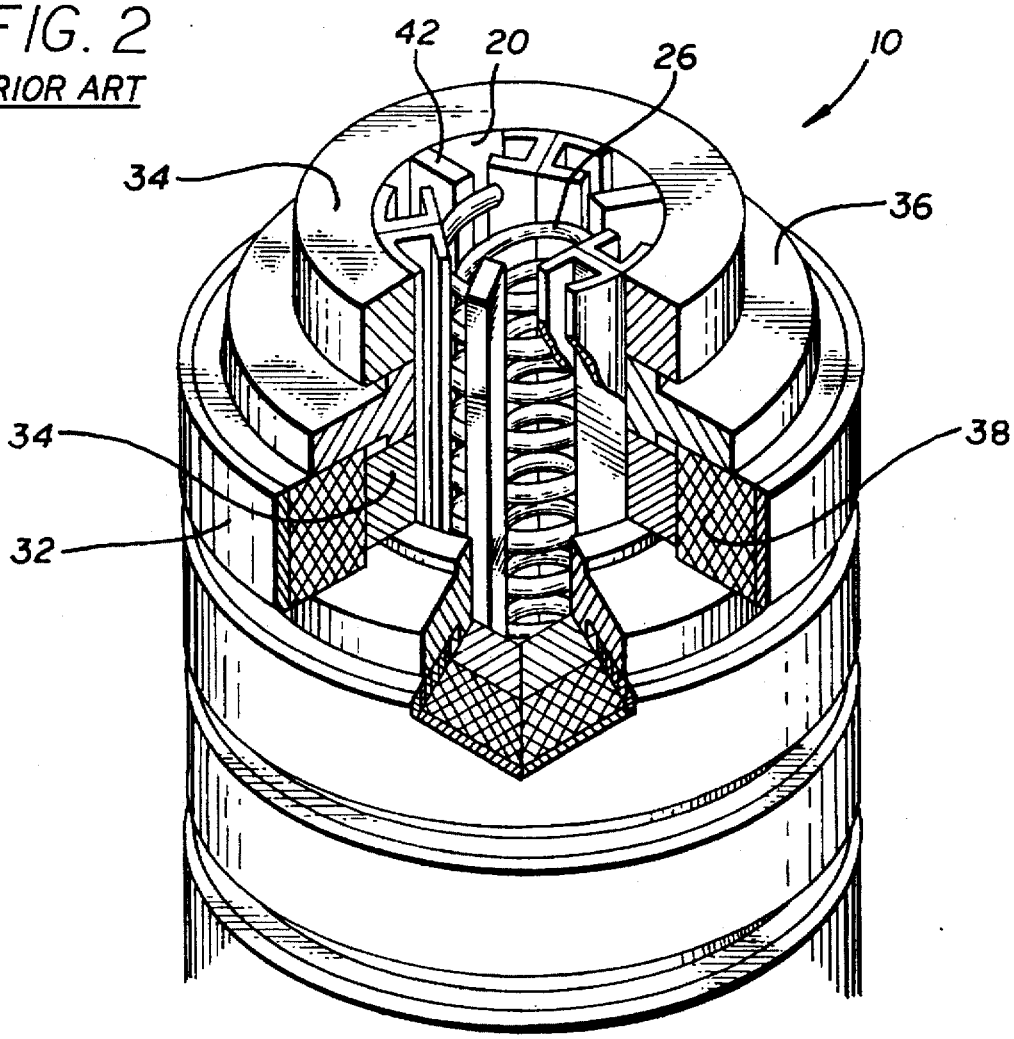
FIG. 2 PRIOR ART
FIG. 2 is a partially cut-away perspective view of a prior art periodic permanent magnet helix TWT.

To guide the electron beam 18 through the drift tube 20, magnetic focusing is typically provided. Referring now to FIG. 2, a conventional focusing structure for the helix TWT 10 is illustrated. The helix 26 is suspended within the drift tube 20 by axial support rods 42, and is surrounded by washer-shaped magnets 38 and polepieces 36. The polepieces 36 are typically formed from a high magnetic permeability material, such as soft iron, or other magnetically conductive iron alloys. The magnets 38 are axially magnetized, and are typically formed from samarium-cobalt material. In addition, non-magnetically conductive spacers 34 are disposed between adjacent polepieces 36, and are formed from copper or cupronickel material. The spacers 34 provide thermal conduction from the drift tube to the polepieces 36. The magnets 38 are supported externally by retaining rings 32. Typically, an external heat sink or coolant jacket (not shown) surrounds the focusing structure externally.

Permanent magnets are commonly used for focusing the electron beam due to their relatively low weight compared to a solenoid type magnet. In periodic permanent magnet focusing, the polepieces 36 direct magnetic flux from the magnets 38 into the drift tube in a path which runs axially through the magnets 38 to the polepieces 36. Next, the flux travels radially inward through the polepieces 36 to the drift tube, and jumps across the gap formed by the nonmagnetic spacers 34 to the adjacent polepieces. The flux then returns radially outward through the polepieces 36 to the magnets 38. Alternating the direction of the polarity of the magnets 38 produces a periodically alternating magnetic field in the drift tube 20. As the beam traverses the alternating magnetic field, the beam develops a rotational motion which oscillates back and forth in alternating directions. This rotation compresses the beam to counteract space-charge forces which would otherwise undesirably expand the beam.

Figure 3:
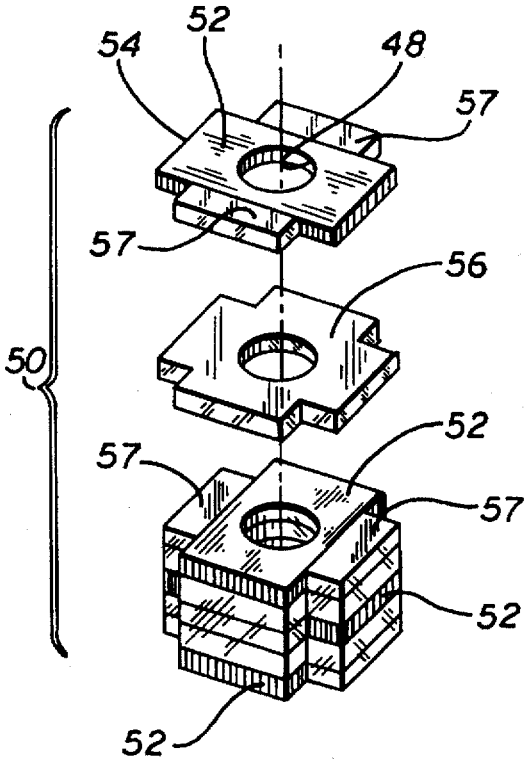
FIG. 3 is an exploded perspective view of the polepieces and spacers of a focusing structure of the present invention.
Figure 4:
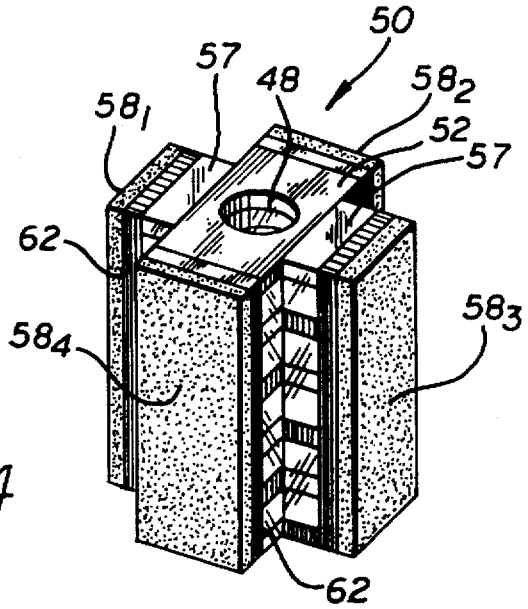
FIG. 4 is a perspective view of the focusing structure of FIG. 3, illustrating radially magnetized permanent magnets affixed to the polepieces.
Figure 5:
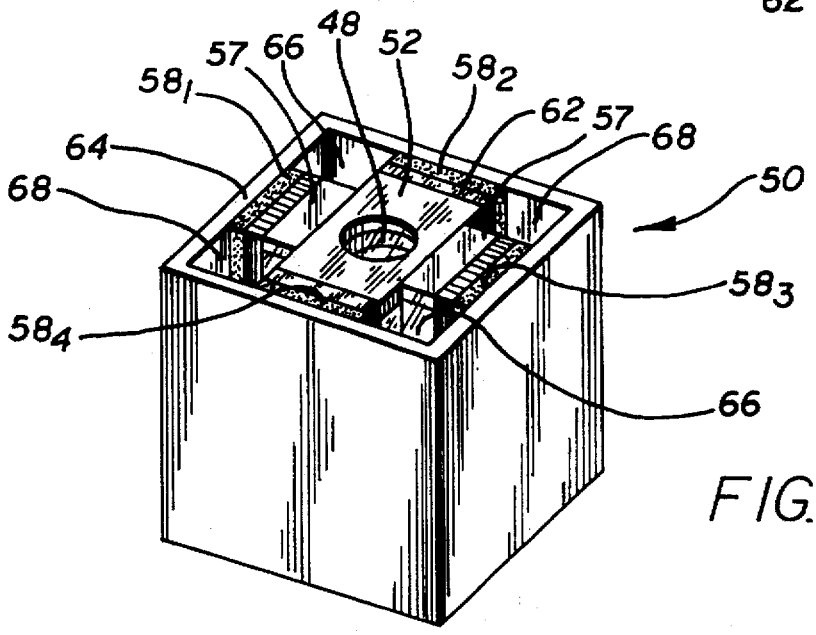
FIG. 5 is a perspective view of the focusing structure of the present invention as in FIGS. 3 and 4, showing the outer shell encapsulating the focusing structure.

It should be apparent that the prior art helix TWT 10 of FIGS. 1 and 2 would be unacceptable for use in a matrix of a phased array. The focusing structure does not prevent magnetic flux leakage external to the structure; in contrast, the magnet flux can readily bridge between adjacent polepieces 36 across the retaining rings 32. Moreover, thermal conductivity is generally radial through the polepieces 36, with limited axial thermal conduction via the spacers 34. These conditions would render the helix TWT 10 impractical when used in close proximity with other like TWTs. The present invention solves each of these problems in a compact and simple structure. The focusing structure 50 of the present invention is illustrated in FIGS. 3–5. The structure 50 comprises a plurality of generally rectangular polepieces 52 which are alternatingly stacked. The polepieces 52 are formed of an electrically and magnetically conductive material, such as iron. Non-magnetic spacers 56 (see FIG. 3) interlace each of the adjacent polepieces 52, and are generally cross-shaped. Each adjacent polepiece 52 is offset 90° from the previous polepiece, and are joined with additional rectangular non-magnetic spacers 57 at side portions of the polepieces 52. The spacers 56 and 57 are formed of thermally conductive and magnetically insulative material, such as copper. The assembled focusing structure 50 has a generally cross-shaped configuration. A beam tunnel 48 extends axially through each of the polepieces 52 and spacers 56, and provides a drift tube for the beam and helix.

Electrically and magnetically conductive end panels 62 (see FIG. 4,5) adjoin each of the end portions 54 (see FIG. 3) of the individual polepieces 52 for each of the four exposed ends. With the end panels 62 in place, the focusing structure 50 resembles a pair of interlaced ladders, with the polepieces 52 comprising "rungs" of the ladders and the end panels 62 comprising "uprights" of the ladders. Radially magnetized permanent magnets $58_1$, $58_2$, $58_3$, $58_4$ having a generally flat rectangular shape are attached to the outer exposed surface of the end panels 62. The entire focusing structure is then encapsulated within a generally rectangular shell 64 (see FIG. 5) formed of a magnetic conducting material.

Although once popular for use in linear beam tubes, radially magnetized permanent magnets have fallen out of favor due to the advent of samarium-cobalt magnets. Previously, radially magnetized magnets formed of alnico (aluminum-nickel-cobalt) were commonly used. Alnico magnets have a maximum energy product at a flux density that is high compared to its magnetization. As a result, it was necessary to increase the diameter of the permanent magnets in relation to the gap length when high field strength was needed in the gap. With the advent of samarium-cobalt magnets, radial magnets became unnecessary because its flux density and magnetization were practically equal for maximum energy product. Washer-shaped axially magnetized permanent magnets generally permit the development of a more compact TWT structure.

However, a radially magnetized samarium-cobalt magnet yields beneficial results in use with the focusing structure 50 of the present invention. The direction of polarity of the magnets $58_1$, $58_2$, $58_3$, $58_4$ alternates circumferentially around the focusing structure 50. In particular, magnets $58_1$ and $58_3$ (see FIGS. 4,5) have a magnetic south polarity facing outward from the structure 50 and a magnetic north polarity facing inward. Conversely, magnets $58_2$ and $58_4$ (see FIGS. 4,5) have a magnetic north polarity facing outward from the structure 50 and a magnetic south polarity facing inward.

Magnetic flux from the first pair of magnets 581 and $58_s$ travels generally inward through the polepieces 52 of a first one of the ladders. Upon reaching the beam tunnel 48, the flux bridges the gap across the adjacent spacer 56 to the adjacent polepiece 52 of the second ladder. The flux then radiates outwardly through the polepieces 52 of the second ladder offset 90° from the first ladder to the second set of magnets $58_2$ and $58_4$. The outer shell 64 provides a magnetic flux return path to maintain the focusing structure in magnetic equilibrium. Accordingly, no flux extends beyond the outer shell 64. By interlacing the polepiece ladder elements, the magnetic field in the drift tube 20 will alternate to focus the electron beam, as in the prior art helix TWT 10 described above.

The generally cross-shaped focusing structure 50 yields four rectangular spaces 66 (see FIG. 5) when disposed within the outer shell 64. These spaces 66 are additionally useful for various alternative purposes. Thermal conductors, such as chill bars 68 (see FIG. 5), can be inserted into the spaces 66 which would draw heat from each of the polepieces 52. The heat drawn by the chill bars 68 can then be removed from the focusing structure axially, rather than radially as in the prior art. The spaces 66 are further useful for the conduit of electrical connections, such as coaxial connection to the helix 26 for attachment of the RF input and output signals. Electrical connection can also be provided to the collector and/or cathode. As known in the art, sufficient shielding of collector interconnections should be accomplished to prevent undesired magnetic field variations within the drift tube.

It is anticipated that the focusing structure 50 can provide the vacuum envelope for the TWT 10. Integral polepiece construction is typically utilized in which the polepieces and spacers are brazed together to form an air tight seal in the beam tunnel 48 to allow the formation of a vacuum within the beam tunnel. However, in an alternative construction, the TWT components are not brazed together, but are merely pressed together, and a vacuum seal is not formed within the beam tunnel 48. In these cases, a separate tube can be slipped into the beam tunnel, and the helix 26 disposed within the tube. Since compact size of the focusing structure 50 is an object of this invention, it would be preferable for the TWT to be in the integral polepiece configuration.

Having thus described a preferred embodiment of a periodic permanent magnet focusing structure for a helix TWT, it should now be apparent to those skilled in the art that certain advantages of have been achieved. The present invention has demonstrated a focusing structure having substantially no magnetic flux leakage as compared to conventional helix TWTs, as well as improved axial thermal conductivity, and would be particularly useful in a phased array radar configuration.

It should also be appreciated by those skilled in the art that various modifications, adaptations, and alternative embodiments thereof may be made within the scope and spirit of the present invention. For example, the focusing structure 50 has been illustrated for use in a helix TWT, but it should be apparent that the inventive concepts can also be applied to alternative linear beam devices, such as coupled cavity tubes and klystrons. In addition, the outer shell 64 may have walls which are in common with other TWTs of a matrix for use in a phased array, rather than to an individual TWT as illustrated above. The invention is further defined by the following claims.

What is claimed is:

1. A magnetic focusing system for an electron beam of a helix traveling wave tube (TWT), comprising:

a focusing structure including a plurality of polepieces, a plurality of non-magnetic spacers respectively interlaced between adjacent ones of said plurality of polepieces, and permanent magnets adjoining outermost ends of each of said plurality of polepieces, said magnets being magnetized in a radial direction, a first portion of said plurality of polepieces being alternatingly disposed orthogonal to a second portion of said plurality of polepieces;

a beam tunnel enclosed by said plurality of polepieces and said plurality of spacers, and extending in an axial direction through said focusing structure for receiving said electron beam; and an outer shell encapsulating said focusing structure;

wherein said plurality of polepieces direct magnetic flux from said magnets to said beam tunnel for focusing of said beam, and said outer shell provides a return path for said magnetic flux to said magnets.

2. The magnetic focusing system of claim 1, wherein said plurality of polepieces are rectangular.

3. The magnetic focusing system of claim 1, wherein a first portion of said magnets adjoin said outermost ends of said first portion of said plurality of polepieces and direct said flux into said beam tunnel, and a second portion of said magnets adjoin said outermost ends of said second portion of said plurality of polepieces and direct said flux out of said beam tunnel.

4. The magnetic focusing system of claim 1, wherein said magnets are comprised of samarium-cobalt material.

5. The magnetic focusing system of claim 1, wherein said spacers are comprised of copper material.

6. A magnetic focusing system for an electron beam of a helix traveling wave tube (TWT), comprising:

a focusing structure including a plurality of polepieces, a plurality of non-magnetic spacers respectively interlaced between adjacent ones of said plurality of polepieces, and permanent magnets adjoining outermost ends of each of said plurality of polepieces, said magnets being magnetized in a radial direction, a first portion of said plurality of polepieces being alternatingly disposed orthogonal to a second portion of said plurality of polepieces;

a beam tunnel enclosed by said plurality of polepieces and said plurality of spacers, and extending in an axial direction through said focusing structure for receiving said electron beam;

an outer shell encapsulating said focusing structure; and at least one chill bar axially disposed in a space defined by an intersection of each of said first and second polepiece portions within said outer shell, said chill bar being thermally conductive in said axial direction, wherein said plurality of polepieces direct magnetic flux from said magnets to said beam tunnel for focusing of said beam, and said outer shell provides a return path for said magnetic flux to said magnets.

7. The magnetic focusing system of claim 6, further comprising an additional space defined by a second intersection of each of said first and second polepiece portions for passage of coaxial cables therethrough.

8. A magnetic focusing system for an electron beam of a helix traveling wave tube (TWT), comprising:

first polepiece means having a first aperture extending therethrough, said first polepiece means conducting magnetic flux to said first aperture, said first polepiece means further having a ladder-shaped configuration;

second polepiece means oriented orthogonal to and interlaced with said first polepiece means and having a second aperture extending therethrough, said first aperture and said second aperture being in communication together to allow said magnetic flux to conduct from said first aperture to said second aperture, said second polepiece means conducting said magnetic flux from said second aperture and also having a ladder-shaped configuration;

a plurality of non-magnetic spacers interlaced between said first polepiece means and said second polepiece means, said spacers having a third aperture extending therethrough; and magnet means for supplying said magnetic flux, said magnet means comprising permanent magnets disposed at respective outer portions of each of said first and second polepiece means, said magnets being magnetized in a radial direction;

wherein said first, second and third apertures are aligned along an axial direction to provide an enclosed drift tube of said TWT, said electron beam travels in said drift tube and said magnetic flux provides focusing of said electron beam.

9. The magnetic focusing system of claim 8, further comprising an outer shell encapsulating said focusing system, said shell providing a return path for said magnetic flux to said magnet means.

10. The magnetic focusing system of claim 8, wherein said magnets adjoining said first polepiece means have a first direction of polarity, and said magnets adjoining said second polepiece means have a second direction of polarity opposite to said first direction.

11. The magnetic focusing system of claim 8, wherein said first polepiece means further comprises:

a plurality of first magnetically conductive polepieces disposed along the axial direction through the drift tube and extending parallel to each other in a radial direction, said plurality of first polepieces being rectangular;

a first pair of end panels joining each of said first plurality of polepieces at respective end portions thereof;

wherein said first plurality of polepieces provide rungs of said ladder-shaped configuration and said end panels provide uprights of said ladder-shaped configuration.

12. The magnetic focusing system of claim 11, wherein said second polepiece means further comprises:

a plurality of second magnetically conductive polepieces disposed along the axial direction through said drift tube and extending parallel to each other in said radial direction, said second plurality of polepieces being rectangular and interlaced with and oriented orthogonal to said first plurality of polepieces; and a second pair of end panels joining each of said second plurality of polepieces at respective end portions thereof;

wherein said second plurality of polepieces provide rungs of said ladder-shaped configuration and said end panels provide uprights of said ladder-shaped configuration.

13. The magnetic focusing system of claim 12, wherein said non-magnetic spacers are respectively interlaced between said first and second pluralities of polepieces, said spacers having a cross-shaped configuration.

14. The magnetic focusing system of claim 13, wherein said spacers are comprised of copper material.

15. The magnetic focusing system of claim 8, wherein said magnets are comprised of samarium-cobalt material.

16. A periodic permanent magnetic focusing system for use in a traveling wave tube (TWT), comprising:

polepiece means having an aperture extending therethrough, said polepiece means conducting magnetic flux to said aperture in a first direction and conducting said magnetic flux from said aperture in a second direction oriented perpendicular to said first direction, said aperture providing an axial drift tube of said TWT;

means for magnetically insulating between said first direction of magnetic flux and said second direction of magnetic flux and for sealing said axial drift tube; and magnet means for supplying said magnetic flux, said magnet means comprising permanent magnets disposed at outer portions of said polepiece means, said magnets being magnetized in a radial direction relative to said axial drift tube;

wherein an electron beam travels in said drift tube and said magnetic flux is provided for focusing of said electron beam.

17. The magnetic focusing system of claim 16, further comprising an outer shell encapsulating said polepiece means, said insulating means and said magnet means, said outer shell providing a magnetic flux return path for said magnet means.

18. The magnetic focusing system of claim 16, wherein said polepiece means further comprises:

a plurality of first magnetically conductive polepieces disposed along said axial direction through said drift tube and extending parallel to each other in said radial direction, said first plurality of polepieces being rectangular;

a plurality of second magnetically conductive polepieces disposed along said axial direction through the drift tube and extending parallel to each other in said radial direction, said second plurality of polepieces being rectangular and respectively interlaced with and oriented orthogonal to said first plurality of polepieces;

a first pair of end panels joining each of said first plurality of polepieces at end portions thereof, said first plurality of polepieces and said first end panels providing a first ladder-shaped member; and a second pair of end panels joining each of said second plurality of polepieces at end portions thereof, said second plurality of polepieces and said second end panels providing a second ladder-shaped member;

wherein said first ladder-shaped member and said second ladder-shaped member are interlaced and orthogonal to each other.

19. The magnetic focusing system of claim 18, wherein said insulating means further comprises a plurality of non-magnetic spacers respectively interlaced between adjacent ones of said first and second polepieces, said spacers having a cross-shaped configuration.

20. The magnetic focusing system of claim 18, wherein a first portion of said magnets adjoin said first end panels having a first direction of polarity, and a second portion of said magnets adjoin said second end panels having a second direction of polarity opposite to said first direction.

* * * * *